US006386539B1

(12) United States Patent
Deskovick

(10) Patent No.: US 6,386,539 B1
(45) **Date of Patent: *May 14, 2002**

(54) GOLF BALL BOARD GAME

(76) Inventor: Robert R. Deskovick, 9 Jonathan Smith Rd., Morristown, NJ (US) 07969

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/375,571

(22) Filed: Aug. 16, 1999

(51) Int. Cl.[7] ..... A63F 9/00

(52) U.S. Cl. ..... 273/153 J; 273/245; 273/259; 273/277

(58) Field of Search ..... 273/236, 241, 273/244, 245, 153 J, 277, 259

(56) References Cited

U.S. PATENT DOCUMENTS

| | | | | |
|---|---|---|---|---|
| 47,491 | A | | 4/1865 | Edson |
| 631,050 | A | | 8/1899 | La Rue Peck |
| 1,033,422 | A | | 7/1912 | Langley et al. |
| 1,640,699 | A | | 8/1927 | Gaston |
| 1,988,988 | A | | 1/1935 | Swayzee |
| 2,017,501 | A | | 10/1935 | Howard |
| 3,625,514 | A | * | 12/1971 | Haaland |
| 3,871,658 | A | | 3/1975 | Shaw |
| 5,188,369 | A | * | 2/1993 | Loewenton |
| 5,358,248 | A | * | 10/1994 | Jankosky |

FOREIGN PATENT DOCUMENTS

GB 1251254 10/1971

OTHER PUBLICATIONS

"Game of the world", by Planetary publication International, pp. 96–97, 1975.*

"The way to play", by Diagram Group, pp. 58–59, 1975.*

"The Way to Play: The Illustrated Encyclopedia of the Games of the World," the Diagram Group, Paddington Press Ltd., 1975: pp. 58–59: "Solitare Board Games", 2 pages.

"Games of the World: How to Make Them, How to Play Them, How They Came to Be," ed. Frederic V. Grunfeld; Plenary Publications International, Inc., 1975; pp. 92–93, 96–97.

* cited by examiner

*Primary Examiner*—Benjamin H. Layno
*Assistant Examiner*—Vishu Mendiratta
(74) *Attorney, Agent, or Firm*—Ernest D. Buff & Associates; Ernest D. Buff

(57) ABSTRACT

A board game wherein a plurality of balls are sequentially removed by a series of jumping moves is scored by playing a series of golf holes. Each of the holes has a par value correlated with the time allotted for play thereof. The game board apparatus has a circular playing surface with 37 depressions thereon arranged in seven parallel rows and an outer depression adjacent to the outside rim of the circular playing surface. The method of playing is a series of rules requiring, first, placing a plurality of golf ball playing pieces in 36 of the 37 depressions atop the circular playing surface except for the center depression, second, jumping the golf ball playing pieces in a horizontal or vertical fashion over adjacent golf ball playing pieces and removing the jumped playing pieces from the circular playing surface, and continuing to jump golf ball playing pieces for at least one minute or until no more jumps may be made, third, counting the remaining golf ball playing pieces atop the circular playing surface, fourth, recording the number of remaining golf ball playing pieces atop the circular playing surface, then repeating steps one through four alternating among a plurality of players until the recorded stroke scores fill all of the entries for each player's row of the score card, tallying the recorded stroke scores, and determining the winner as the player with the lowest tally.

18 Claims, 3 Drawing Sheets

GOLF BALL BOARD GAME

BACKGROUND OF THE INVENTION

1. Field of the Invention

The present invention relates to a circular board game; and more specifically a game providing a post golf round activity for golf partners with a golf theme that accommodates golf enthusiasts of various ages and golf abilities.

2. Description of the Prior Art

It is well known in the golf community that a round of golf does not end at the eighteenth hole. Oftentimes golf partners "extend" the round by gathering at the "19th Hole"—oftentimes a clubhouse lounge, bar, restaurant, or pool—to relax, eat and drink. This relaxation time is a welcome resbit after a long golf round played in sun, wind, or rain. It rejuvenates the golfer and provides a "safe harbor" in which golfers forget failed sand trap shots and sliced tee-offs, and revel in their low scoring holes. Golfers frequently augment post round conversations with additional activities, since the usual topics of conversation have previously been exhausted during the round. There is needed a mind stimulating activity having a golf theme that provides for competition among golf partners which is not directly related to golf ability, but which is relaxing and entertaining.

Many games proposed by prior art workers provide mind stimulating, yet simple forms of entertainment. These games have been proposed as entertaining mind exercises; but not as post golf activities. For example, *The Way to Play: The Illustrated Encyclopedia of the Games of the World* describes a number of single player, solitaire board games having a game board surface with grooves thereon to accommodate game pieces such as marbles or pegs. Each of the solitaire board games involve jumping pegs over adjacent pegs to land in an open groove, with the pegs which have been jumped over removed from the playing board. Some of the games have as an objective to clear the board of all of the game pieces. Other games require the player to position the game pieces in a specific pattern. Each solitaire game is considered won only if its exact objective has been met; therefore, a player will have to make numerous attempts to work out a winning solution.

U.S. Pat. No. 1,033,422 to Langley et al., describes a board game wherein the board apparatus comprises an arrangement of grooves and pegs. To play the game, a single player uses straight and diagonal jumps to jump pegs until a single peg remains located in the center groove. U.S. Pat. No. 2,017,501 to Howard discloses a game board apparatus having grooves for receiving playing pieces. The game board described therein is useful for games requiring progressive removal of playing pieces from the game board. Additionally, the game board provides a storage space for the game pieces. U.S. Pat. No. 631050 to La Rue Peck pertains to a solitaire board game with a board apparatus having grooves for placement of game pieces. The game board is further designed with numbered positions on its surface with start, home and field divisions. The object of this game is to move the game pieces in the grooves according to combinations formed between a game piece number and the number delineated by a vacant groove.

In another instance, the prior art proposes a mind stimulating game having a golf theme. For example, U.S. Pat. No. 5,358,248 to Jankosky discloses a golf board game with a playing board having a graphical depiction of a golf hole with stroke values printed throughout and an array of grooves thereon. Playing pieces are located in the grooves on the board. To commence play, the player jumps peg playing pieces over adjacent pegs to empty grooves of the board. Each peg which has been jumped over is removed from the board and the player continues jumping pegs until no more such jumps are made. The remaining playing pieces are assigned a specific stroke value based on the stroke value printed on the board in the area in which the game pieces remain. The player's score for a hole is the total stroke value obtained by adding the values of each remaining peg.

None of these prior art games provides a multiple player, amusing post-golf game with a golf theme, having a strategic set of rules in which a standard golf score card may be used. What is needed is a game in combination with a set of rules which accommodates multiple players having differing ages and golf skills, utilizes a golf theme and requires a keen sense of mental skill. Such a device provides a relaxing but competitive mental skill exercise especially adapted for participation by golfers after the eighteenth hole.

SUMMARY OF THE INVENTION

In accordance with the present invention, there is provided a golf ball board game comprising (a) a circular playing surface having 37 depressions arranged in seven parallel rows in which three of the parallel rows have seven depressions therein, two of the rows have five depressions therein, one of which is positioned adjacent to a first side of the three parallel rows of seven, the other of which is positioned adjacent to a second side of the seven parallel rows, and two of the parallel rows have three depressions therein, one of which is positioned adjacent to a first side of said parallel rows of five depressions therein, the other of which is positioned adjacent to a second side of the parallel row of five depressions, said circular surface further comprising a depression located adjacent to an outside edge of the circular playing surface; and (b) a series of rules comprising the steps of (1) placing a plurality of detachable golf ball playing pieces in 36 of the 37 depressions arranged on said circular playing surface in each of the depressions located therein except for the depression positioned in the centermost portion of the seven parallel rows; (2) jumping said detachable golf ball playing pieces in a horizontal or vertical fashion over adjacent detachable golf ball playing pieces and removing a golf ball playing piece which has been jumped over from the circular playing surface, (3) repeating step (2) for at least one minute, or until no more jumps may be made; (4) counting the number of remaining golf balls left on the circular playing surface; (5) recording the number of balls left on the circular playing surface as an entry on a score card as an amount equal to the number of golf strokes attempted per hole; (6) repeating steps (1) through (5) for each one of a plurality of separate players for the golf hole; (7) tallying the number of said recorded strokes in each entry for each of said players; and (8) comparing each player's tally. The player with the lowest tally is the winner.

The golf ball board game apparatus comprises a circular playing surface consisting of a rigid material, preferably plastic, wood or fiberglass. Plastic is the most preferred material for the game board because it is sturdy and may be cleaned of dirt and grime easily. The golf ball playing pieces are comprised of standard size golf balls. Advantageously, golf ball playing pieces are easy to handle, easy to see, and are not easily broken. Additionally, if one of the golf ball playing pieces should roll away or become lost, it is likely that a golf player after a round of golf has extra golf balls in their bag wherein they may replace the missing golf ball playing piece and proceed playing the golf ball board game. Moreover, the use of golf ball playing pieces enhances the golf aspect of the game.

The seven parallel rows located on the circular playing surface are positioned with at least enough space in between the rows to accommodate the golf ball playing pieces. Thus, a player may rest a ball which is not in play between any of the seven parallel rows. This provides a convenient means for removing golf balls from the playing surface. The depressions located on the circular playing surface in which the golf balls rest are deep enough to accommodate at least the bottom portion of the golf ball playing pieces. In this way, the board can be moved without disturbing the arrangement of golf balls thereon.

In play, each player takes turns at clearing the circular playing surface of golf balls. The rules require that the pre-determined time play period for a hole is at least one minute and the pre-determined par value of each hole is equivalent to four. The scoring is similar to a par four hole of golf wherein one ball left on the golf ball playing surface is equivalent to a hole in one and a score of one; two balls left on the golf ball playing surface are equivalent to an eagle and a score of two; three balls left on the golf ball playing surface are equivalent to a birdie and a score of three; four balls left on the golf ball playing surface are equivalent to par and a score of four; five balls left on the golf ball playing surface are equivalent to a bogey and a score of five; six balls left on the golf ball playing surface are equivalent to a double bogey and a score of six; and seven balls left on the golf ball playing surface are equivalent to a triple bogey and a score of seven. The aforementioned scoring retains the golf theme of the board game, equalizes the playing field among golf partners, and helps to teach beginning golf players about the terms associated with the number of strokes taken per hole.

Advantageously, the game apparatus and series of rules of the present invention offer golf partners an entertaining, post-golf round activity that may be played in the clubhouse, club bar, restaurant, or pool. The mind stimulating game activity eases tension which may accumulate while golfing, and helps re-focus the golfer away from sliced shots or penalty strokes encountered during the round. Scoring each hole played and tallying the total score develops a sense of competition among players. Golf skills of the players are equalized, leaving each player with a fair chance of winning the golf ball game.

In another aspect of the present invention there is provided a modification in the scoring whereby a pre-determined time play period varies in proportion to a pre-determined par value. The scoring may vary for each hole played. For example, the time play period for a hole may be range from at least one minute to at most three minutes in combination with a par score equal to five. The time play period may range from at least two minutes to at most four minutes for a par score equal to four. A time play period of at least three minutes and at most five minutes would be allotted for a hole having a par value of three.

The alternate embodiment, with each hole having scoring which comprises a pre-determined time play period in proportion to a pre-selected par value, is the most useful and preferred embodiment of the golf ball board game of the present invention. This embodiment advantageously increases the mental preparation and planning required for each jump. The timed play periods add excitement, require strategic planning, and enhance competition as players endeavor to make the right moves and decisions, within the allotted time, to clear the board of as many playing pieces as possible.

In yet another aspect of the present invention there is provided a modification in the golf ball playing pieces whereby the golf balls are comprised of various colors. In one embodiment using a plurality of colors for golf ball playing pieces, each color is assigned a positive or negative value. The value increases or decreases the stroke score of a hole if left remaining on the circular playing surface at the end of a pre-determined time play period or when no more moves may be made. In a second embodiment using golf ball playing pieces comprised of a plurality of colors, a first player is assigned golf ball playing pieces having a first color, and may only jump golf ball playing pieces having the first color, while a second player is assigned playing pieces having a second color and may only jump golf ball playing pieces having such second color. Each player's score is counted at the end of a pre-determined time period, or when no more moves may be made. This embodiment creates an even more challenging version of the golf ball board game, since the first player must now account for jumps made by a second player on the circular playing surface during play on the same hole. This embodiment requires patience and anticipation by each player of the next few moves to be made.

In each of the aforementioned embodiments, the golf ball board game apparatus in combination with a series of rules provides a mind stimulating and entertaining post-golf activity for a plurality of players of different age groups and golfing abilities.

BRIEF DESCRIPTION OF THE DRAWINGS

The invention will be more fully understood and further advantages will become apparent when reference is made to the following detailed description of the preferred embodiments and the accompanying drawings in which.

DETAILED DESCRIPTION OF THE INVENTION

Figure 1:
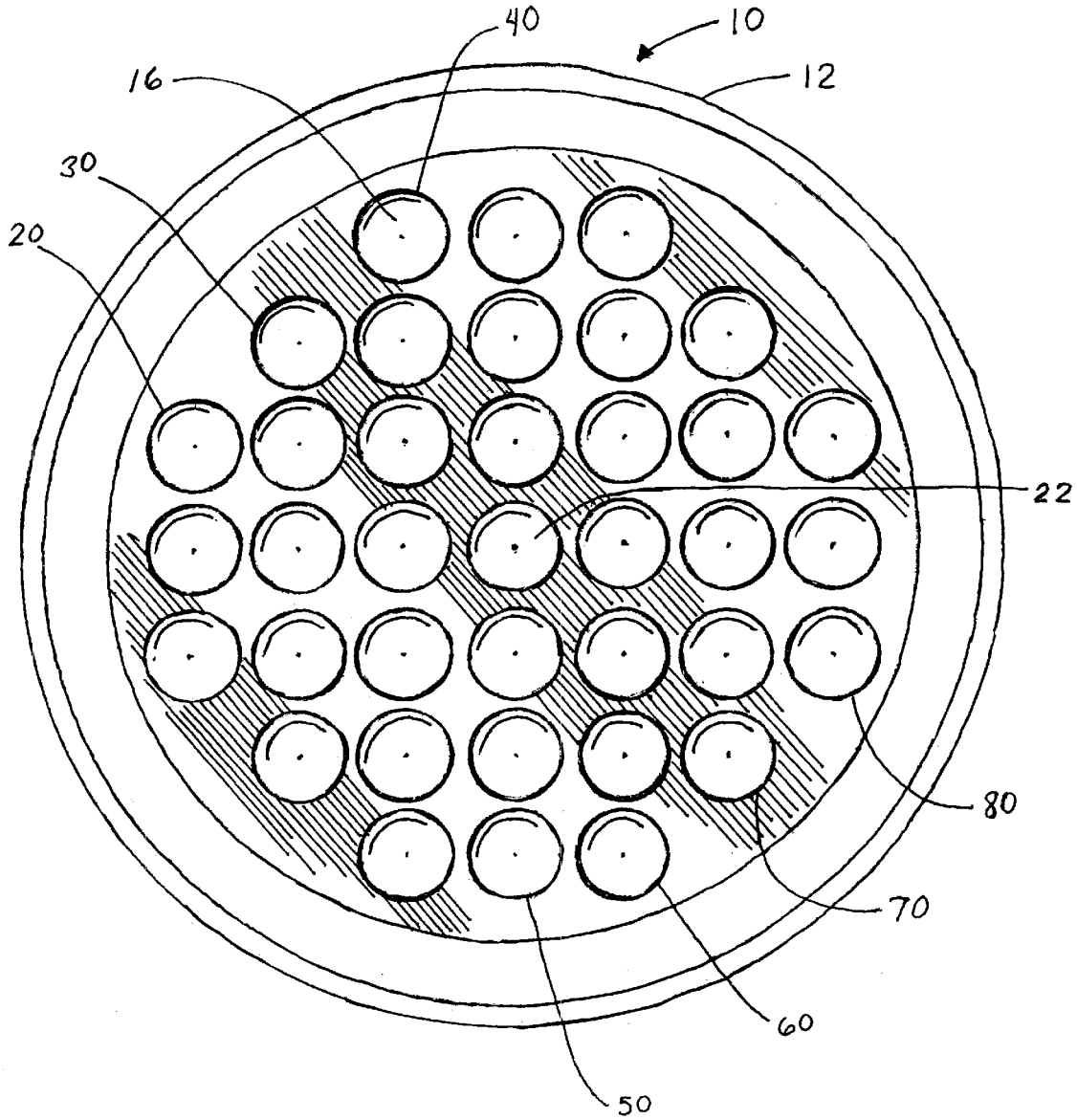
FIG. 1 shows the top view of the circular playing surface of the golf ball board game.

The present invention relates to a stationary golf ball board game having a specific series of rules. Generally stated, the golf ball board game of the present invention comprises:

(a) a circular playing surface having 37 depressions arranged in seven parallel rows in which three of said parallel rows have seven depressions therein, two of said parallel rows have five depressions therein, one of which is positioned adjacent to a first side of said three parallel rows, the other of which is positioned adjacent to a second side of said three parallel rows, and two of said parallel rows have three depressions therein, one of which is positioned adjacent to a first side of said parallel rows having five depressions, the other of which is positioned adjacent to a second side of said parallel row having five depressions, said circular playing surface further comprising a depression located adjacent to an outside edge of the circular playing surface; and (b) a series of rules, comprising the steps of:

(1) placing a plurality of detachable golf ball playing pieces in 36 of the 37 depressions arranged on said circular playing surface in each of the depressions located therein except for a depression positioned in the centermost portion of the seven parallel rows, (2) jumping said detachable golf ball playing pieces in a horizontal or vertical fashion over adjacent detachable golf ball playing pieces and removing a golf ball playing piece which has been jumped over from said circular playing surface, (3) repeating step (2) for at least one minute or until no more jumps may be made, (4) counting the remaining detachable golf ball playing pieces atop the circular playing surface, (5) recording the number of said remaining detachable golf balls on an entry in a score card as an amount equal to the number of golf strokes attempted for a golf hole, (6) repeating steps (1) through (5) for each one of a plurality of separate players for the golf hole, (7) tallying the number of said recorded strokes for each of said players, and (8) comparing each player's tally.

Advantageously, the golf ball game contemplated by the present invention provides a well suited, post-golf round activity for golf partners or individuals. Competition among golf partners continues on a level not consonant with golf ability. As such, a golf player with average skills may win the game by scoring a low amount of strokes on each hole and earning a lower total score than a more skilled golf player. The golf ball board game scoring methodology makes the game challenging by requiring players to jump and position the golf ball playing pieces with strategically planned jumps, executed quickly and efficiently, within a pre-determined time playing period. Moreover, the scoring methodology requires a golf player to focus on the task at hand, inevitably stimulating the mind while providing entertainment. Accordingly, the golf ball board game apparatus in connection with a unique series of rules provides a multiple player post-golf round activity having a golf theme that is entertaining, relaxing, competitive, challenging and mind stimulating.

The invention can be more fully understood from the following description in connection with the appended drawings. Turning now to FIG. 1 of the drawings there is shown a top view of the game board 10. Broadly stated, the game board 10 comprises a circular playing surface 12 with thirty-seven depressions 16, arranged in seven parallel rows 20, 30, 40, 50, 60, 70 and 80; and an outside track 14.

Figure 2:
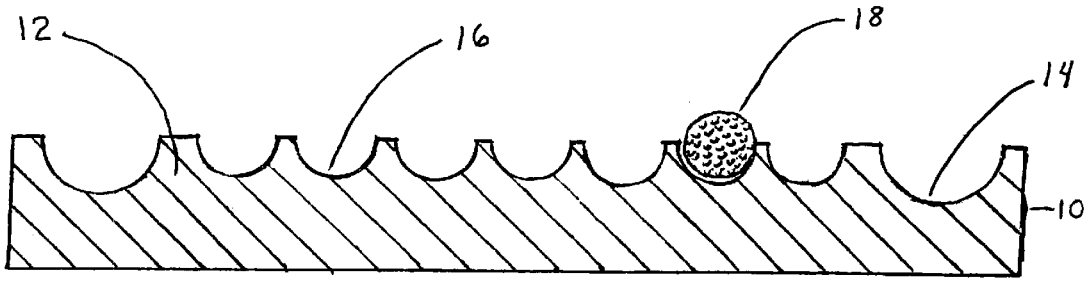
FIG. 2 is a cross section of the game board showing the two depressions of the outside track and the seven depressions for accommodating the golf ball playing pieces, with one of the golf ball playing pieces in place.
Figure 3:
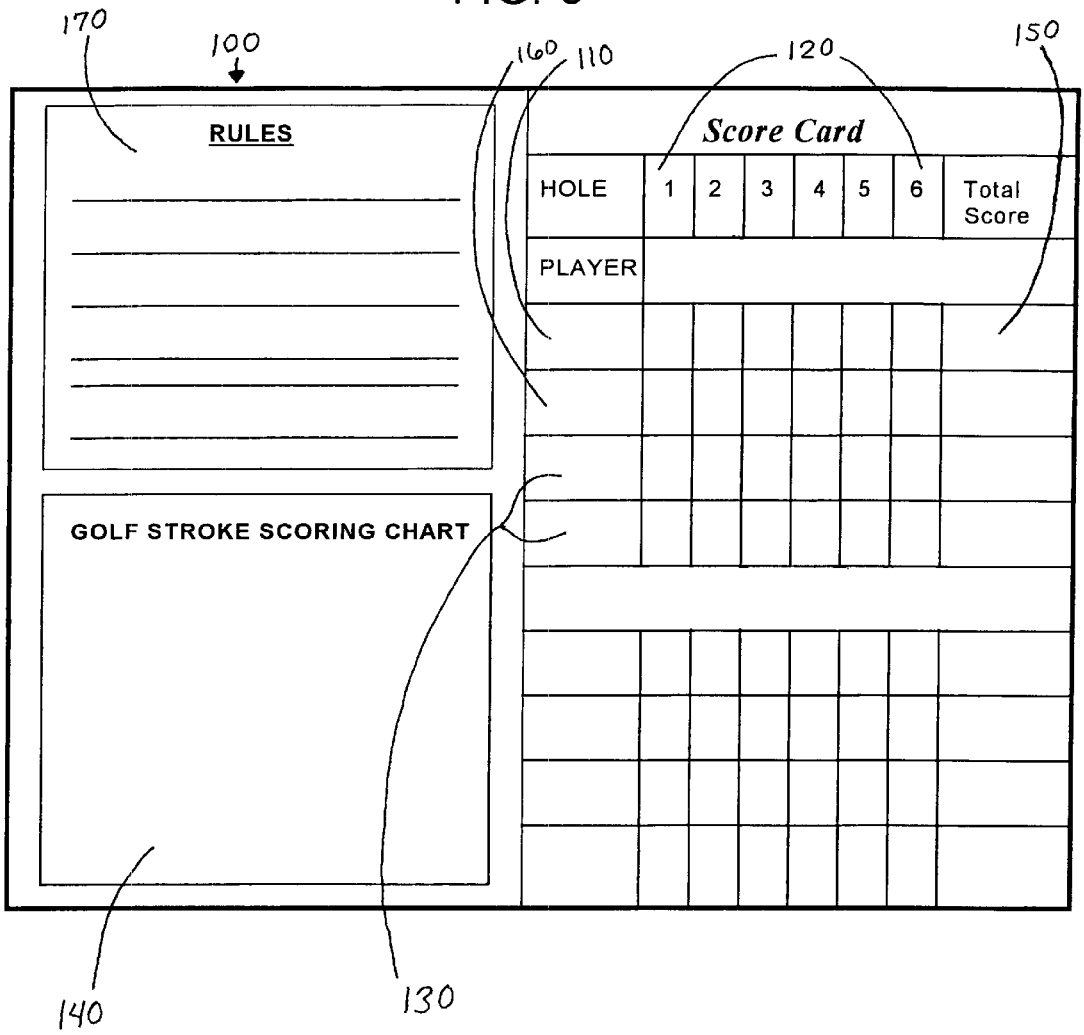
FIG. 3 is a front view of the score card having a rules chart and golf stroke scoring chart on the left side, and a scoring grid on the right side comprised of a plurality of columns for the score of each hole played and a plurality of rows for defining hole number, player name, pre-determined time playing period and pre-selected par value.

More specifically, the seven parallel rows 20, 30, 40, 50, 60, 70 and 80 are arranged in the following manner: three of the seven parallel rows 40, 50 and 60, have seven depressions 16 each. Two of the seven parallel rows, 30 and 70 have five depressions 16 each. Parallel row 30 is positioned adjacent to a first side of the three parallel rows, specifically next to row 40. Parallel row 70 is positioned adjacent to a second side of the three parallel rows, specifically next to row 60. The last two parallel rows, 20 and 80 have three depressions each. Parallel row 20 is positioned adjacent to a first side of parallel row 30 and parallel row 80 is positioned adjacent to a second side of parallel row 70. The circular playing surface 12 is further comprised of an outside track 14. The outside track 14 is a depression located adjacent to an outside edge of the circular playing surface. The outside track 14 has a concave depth to accommodate a golf ball. FIG. 2 illustrates a cross-sectional view of the outside track 14.

The circular playing surface 12 is preferably comprised of a rigid material. The rigid material may be plastic, wood or fiberglass. While wood and fiberglass are particularly useful materials for the game board, plastic is the most preferred rigid material.

The golf ball playing pieces 18 are comprised of standard size golf balls. Accordingly, the seven parallel rows 20, 30, 40, 50, 60, 70 and 80 are positioned with at least enough space in between them to accommodate placement of the golf ball playing pieces 18. The depressions 16 atop the circular playing surface 12 are sized to accommodate the golf ball playing pieces 18. The depressions 16 are shallow enough to cradle the bottom quarter of the golf ball playing pieces and may be deep enough to cover more than half of the golf ball playing pieces 18. The most preferred depth of the depressions 16 is one in which three quarters of the golf ball is showing. This helps to maintain stability of the golf ball playing pieces 18 atop the circular playing surface 12, should one of the golf ball playing pieces 18 be inadvertently pushed out of a depression 16 when a player is jumping another golf ball playing piece 18. Additionally, having three quarters of the golf ball playing pieces 18 showing makes the golf ball playing pieces 18 easy to see and pick up.

In accordance with the present invention, a player performs a series of steps for each "hole". The player begins by first placing a plurality of detachable golf ball pieces 18 in thirty-six of the thirty-seven depressions arranged on the circular playing surface 12, leaving the center depression 22 vacant. FIG. 2 more specifically illustrates a cross-sectional view of the game board 10 with a golf ball playing piece placed within a depression 16.

Second, a player jumps detachable golf ball playing pieces 18 in a horizontal or vertical fashion over adjacent detachable golf ball playing pieces 18. The player may not jump the detachable golf ball playing pieces 18 diagonally over adjacent detachable golf ball playing pieces 18, and may not jump detachable golf ball playing pieces 18 to the outside track 14. The player continues to jump detachable golf ball playing pieces 18 until the pre-determined time playing period 110 expires or until no more moves may be made.

Third, the remaining detachable golf ball playing pieces 18 on the circular playing surface 12 are counted. The number of remaining detachable golf ball playing pieces 18 is equivalent to number of golf strokes attempted. Fourth, the number of golf strokes are recorded on the score card 100 in an entry corresponding to the column for the hole 120 played and the row defining the player 130.

A plurality of players alternate turns playing a hole of the present invention by repeating steps one through four until all the score entries on the score card 100 in the rows defining each player 130 are filled. Then, each player tallies the number of recorded strokes and player totals are placed in the total score column 150 located on the score card 100. The winner of the game is the player with the lowest tally in the total score column 150.

In a preferred embodiment, scoring may be set whereby each hole 120 has a pre-determined time playing period 10 and a pre-selected par value 160. For instance, a pre-determined time playing period 110 of a hole equal to at least one minute and at most three minutes may be combined with a pre-selected par value 160 equal to five. More preferably, each hole has a three minute pre-determined time playing period 110 and a pre-selected par value 160 equal to five. In another instance, the pre-determined time playing period 110 of a hole equal to at least two minutes and at most four minutes is combined with a pre-determined par value 160 equal to four. In this instance, a pre-determined time playing period 110 of four minutes in connection with a pre-selected par value 160 of four is preferred. In yet another instance, a pre-determined time playing period 110 of a hole equal to at least three minutes and at most five minutes is combined with a pre-selected par value 160 equal to three. In this instance, a pre-determined time playing period 110 of five minutes in connection with a pre-selected par value 160 of three is preferred. Any combination of scoring for different holes as discussed above is within the scope of the present invention. Alternatively, the scoring may be set to require a maximum pre-determined time playing period of five minutes.

The most preferred embodiment for keeping score for each hole comprises various pre-determined time playing periods 110 correlated with pre-selected par values 160. This varied scoring methodology consonant with a golf theme advantageously appeals to golf enthusiasts. The scoring methodology in combination with the game board 10 also satisfies the need for a challenging, competitive and mind-stimulating post-golf activity. In addition, the method of keeping score, together with a golf theme advantageously helps to teach individuals the proper way to keep score in an actual golf game. To keep track of the scoring requirements for their respective holes, the scoring requirements are preferably located on the score card 100 in a pre-determined time playing period 110 row and a pre-selected par value 160 row.

As previously indicated, golf ball playing pieces 18 are placed in thirty-six of the thirty-seven depressions. Typically all thirty-six of the golf ball playing pieces 18 are comprised of the same color. Alternatively, the golf ball playing pieces 18 may comprise a plurality of colors.

In one alternative embodiment, a plurality of colors represent different point values. For instance, a golf ball playing piece 18 comprised of a first color accords a point value of one to the golf ball playing piece 18. As such, when the golf ball playing piece 18 having the first color is left on the circular playing surface 12 at the end of a pre-determined time playing period 110 or when no more moves may be made, the point value of one is added to the player's total stroke score for that hole. The score increase for a hole is equivalent to a golf penalty stroke. In another instance, the series of rules may require that a golf ball playing piece 18 of a second color is equivalent to a plurality of positive points that increase total stroke score. In yet another instance, the series of rules may require that a golf ball playing piece 18 comprising a third color decreases the total stroke score of the hole by one when left on the circular playing surface 12 at the end of a pre-determined time playing period 110 or when no more moves may be made. Moreover, in another instance, the series of rules may require that a golf ball playing piece 18 comprising a fourth color decreases the score of the hole by a plurality of points when left on the circular playing surface 12 at the end of a pre-determined time playing period 110 or when no more moves may be made.

In a second alternative embodiment wherein the golf ball playing pieces 18 comprise a plurality of colors, a golf ball playing piece 18 of one color is only jumpable by one player while a golf ball playing piece 18 of another color is only jumpable by a second player. Accordingly, this rule would allow a plurality of players to participate in the jumping moves of one hole. While the two alternative embodiments enhance the complexity of the game, the most preferred embodiment comprises thirty six golf ball playing pieces 18 of the same color. Having all of the golf ball playing pieces 18 the same color makes the game easy to remember and to explain to fellow golf partners who have never played the golf ball board game.

While the present invention has been described as a golf ball board game adapted to be played with golf balls and a playing board, it will be understood to those skilled in the art that various electronic iterations of the invention may also be devised. Such electronic iterations may be further adapted to permit the game to be played on computers. The software for these electronic iterations may be readily accessed by downloading from the Internet. Further, other electronic versions of the present invention may provide means for one or more persons to play the game of this invention on the Internet, itself. Such electronic iterations of the game are considered to be within the scope of the present invention.

Having thus described in invention in rather full detail, it will be recognized that such detail need not be strictly adhered to but that various changes and modifications may suggest themselves to one skilled in the art, all falling within the scope of the invention, as defined by the subjoined claims.

What is claimed is:

1. A method for playing a golf ball board game comprising the steps of:

(a) moving a plurality of detachable golf ball playing pieces on a circular playing surface having 37 depressions arranged in seven parallel rows, in which (1) three of said parallel rows have seven depressions therein;

(2) two of said parallel rows have five depressions therein, one of said two parallel rows being positioned adjacent to a first side of said three parallel rows, and the other being positioned adjacent to a second side of said three parallel rows; and (3) two of said parallel rows have three depressions therein, one of which being positioned adjacent to a first side of said parallel rows having five depressions, and the other of which being positioned adjacent to a second side of said parallel row having five depressions;

(4) said circular playing surface further comprising a depression located adjacent to an outside edge of the circular playing surface; and (b) said movement of said pieces being accomplished in accordance with a series of rules, comprising the steps of:

(1) placing a plurality of detachable golf ball playing pieces in 36 of the 37 depressions arranged on said circular playing surface, such that one detachable golf ball playing piece is positioned in each of the depressions, except for a depression located at a centermost position of the seven parallel rows;

(2) jumping said detachable golf ball playing pieces in a horizontal or vertical direction over adjacent detachable golf ball playing pieces and removing a golf ball playing piece which has been jumped over from said circular playing surface;

(3) repeating step (2) during a timed play period of at least one minute or until no more jumps may be made;

(4) counting the remaining detachable golf ball playing pieces atop the circular playing surface;

(5) recording the number of said remaining detachable golf balls on an entry in a score card as an amount equal to the number of golf strokes attempted for a golf hole having a predetermined par value;

(6) repeating steps (1) through (5) for each one of a plurality of separate players for the golf hole;

(7) tallying the number of said recorded strokes for each of said players;

(8) comparing each player's tally against said predetermined par value for said hole; and (9) repeating steps (1) through (8) for a plurality of holes, said holes having at least three differently timed predetermined play periods corresponding to three different preselected par values, and said par values varying inversely with said play period times.

2. A method for playing a golf ball board game as recited in claim 1, wherein said circular playing surface comprises a rigid material.

3. A method for playing a golf ball board game as recited in claim 2, wherein the colored golf ball playing piece equals one point that increases total score.

4. A method for playing a golf ball board game as recited in claim 1, wherein said circular playing surface comprises a material selected from the group of plastic, wood, or fiberglass.

5. A method for playing a golf ball board game as recited in claim 1, wherein said circular playing surface is plastic.

6. A method for playing a golf ball board game as recited in claim 1, wherein said golf ball playing pieces comprise standard size golf balls.

7. A method for playing a golf ball board game as recited in claim 1, wherein said seven parallel rows are positioned with at least enough space between said rows to accommodate placement of said golf ball playing pieces.

8. A method for playing a golf ball board game as recited in claim 1, wherein said depressions can accommodate the lower quarter portion of said golf ball playing pieces.

9. A method for playing a golf ball board game as recited in claim 1, wherein each hole has a par score equal to five and said timed play period for each of said players to complete the jumps for said hole ranges from one minute to about three minutes.

10. A method for playing a golf ball board game as recited in claim 1, wherein each hole has a par score equal to four and said timed play period for each of said players to complete the jumps for said hole ranges from about two minutes to about 4 minutes.

11. A method for playing a golf ball board game as recited in claim 1, wherein each hole has a par score equal to three and said timed play period for each of said players to complete the jumps for said hole ranges from about three minutes to about five minutes.

12. A method for playing a golf ball board game as recited in claim 1, wherein said timed play period for each of said players to complete the jumps for said hole ranges up to five minutes.

13. A method for playing a golf ball board game as recited in claim 1, wherein said golf ball playing pieces comprises at least one colored golf ball playing piece.

14. A method for playing a golf ball board game as recited in claim 13, wherein the colored golf ball playing piece equals a plurality of points that increase total score.

15. A method for playing a golf ball board game as recited in claim 13, wherein the colored golf ball playing piece equals one point that decreases total score.

16. A method for playing a golf ball board game as recited in claim 13, wherein the colored golf ball playing piece equals a plurality of points that decrease total score.

17. A method for playing a golf ball board game as recited in claim 13, wherein a golf ball playing piece having a first color signifies a golf ball playing piece moveable solely by a first player and a golf ball playing piece having a second color signifies a playing piece moveable solely by a second player.

18. A method for playing a golf ball board game comprising the steps of:

(a) moving a plurality of detachable golf ball playing pieces on a circular playing surface having a plurality of depressions arranged in more than one parallel row wherein at least one of said rows has less depressions than the remainder of said depressions in said parallel rows;

(b) said movement of said playing pieces being accomplished in accordance with a series of rules, comprising the steps of:

(1) placing a plurality of detachable golf ball playing pieces in at least one of the depressions arranged on said circular playing surface except for a depression positioned in a centermost position of the parallel rows;

(2) jumping said detachable golf ball playing pieces in a horizontal or vertical fashion over adjacent detachable golf ball playing pieces and removing a golf ball playing piece which has been jumped over from said circular playing surface;

(3) repeating step (2) during a timed play period of at least one minute or until no more jumps may be made;

(4) counting the remaining detachable golf ball playing pieces atop the circular playing surface;

(5) recording the number of said remaining detachable golf balls on an entry in a score card as an amount equal to the number of golf strokes attempted for a golf hole having a predetermined par value;

(6) repeating steps (1) through (5) for each one of a plurality of separate players for the golf hole;

(7) tallying the number of said recorded strokes for each of said players;

(8) comparing each player's tally against said predetermined par value for said hole; and (9) repeating steps (1) through (8) for a plurality of holes, said holes having at least three differently timed predetermined play periods corresponding to three different preselected par values, and said par values varying inversely with play period times.

* * * * *